US011181313B2

(12) United States Patent
Krapp et al.

(10) Patent No.: US 11,181,313 B2
(45) Date of Patent: Nov. 23, 2021

(54) DOMESTIC APPLIANCE

(71) Applicant: BSH HAUSGERAETE GMBH, Munich (DE)

(72) Inventors: Michael Krapp, Nattheim (DE); Andreas Kemmer, Heidenheim (DE); Michael Seelmeier, Heuchlingen (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/758,070

(22) PCT Filed: Nov. 21, 2018

(86) PCT No.: PCT/EP2018/082093
§ 371 (c)(1),
(2) Date: Apr. 22, 2020

(87) PCT Pub. No.: WO2019/110307
PCT Pub. Date: Jun. 13, 2019

(65) Prior Publication Data

US 2021/0190411 A1 Jun. 24, 2021

(30) Foreign Application Priority Data

Dec. 5, 2017 (DE) ..... 102017221904.1

(51) Int. Cl.
*F25D 23/00* (2006.01)
*F24C 15/08* (2006.01)
*F25D 23/06* (2006.01)

(52) U.S. Cl.
CPC ..... *F25D 23/006* (2013.01); *F24C 15/08* (2013.01); *F25D 23/065* (2013.01); *F25D 23/067* (2013.01); *F25D 2500/02* (2013.01)

(58) Field of Classification Search
CPC .... F25D 23/006; F25D 23/067; F25D 23/065; F25D 2500/02
See application file for complete search history.

(56) References Cited

U.S. PATENT DOCUMENTS 1,815,170 A * 7/1931 Summers ..... F25D 23/006 248/621
5,810,322 A * 9/1998 Zhao ..... F25D 23/006 248/606
2005/0217301 A1* 10/2005 Iguchi ..... F25D 19/02 62/302

(Continued)

FOREIGN PATENT DOCUMENTS

CN 1677031 A 10/2005
CN 1786630 A 6/2006

(Continued)

*Primary Examiner* — Daniel J Rohrhoff
(74) *Attorney, Agent, or Firm* — Laurence A. Greenberg; Werner H. Stemer; Ralph E. Locher

(57) ABSTRACT

A household appliance includes at least one appliance body which has at least one wall element that at least partly delimits at least one isolation chamber. At least one fixing element is disposed on the wall element and is provided in order to fix at least one component to the wall element. In order to provide the device with improved assembly properties, the fixing element protrudes in a direction facing away from the isolation chamber beyond a plane spanned by the wall element.

13 Claims, 10 Drawing Sheets

(56) References Cited

U.S. PATENT DOCUMENTS

| | | | | |
|---|---|---|---|---|
| 2006/0117789 | A1 | 6/2006 | Yamasaki et al. | |
| 2019/0107323 | A1* | 4/2019 | Dai | F25D 23/065 |
| 2020/0166271 | A1* | 5/2020 | Hosamani | F25D 23/06 |

FOREIGN PATENT DOCUMENTS

| | | | | |
|---|---|---|---|---|
| CN | 203629191 | U | 6/2014 | |
| DE | 102010002043 | A1 | 8/2011 | |
| DE | 102013225651 | A1 | 6/2015 | |
| EP | 1669707 | A2 | 6/2006 | |
| EP | 3327379 | A1 * | 5/2018 | F25D 11/02 |
| EP | 3327384 | A1 * | 5/2018 | F25D 17/047 |
| GB | 1211274 | A | 11/1970 | |
| JP | 2002081851 | A | 3/2002 | |

* cited by examiner

DOMESTIC APPLIANCE

BACKGROUND OF THE INVENTION

Field of the Invention:

The invention relates to a household appliance device including at least one appliance body which has at least one wall element that at least partly delimits at least one isolation chamber, and at least one fixing element which is disposed on the wall element and is provided in order to fix at least one component to the wall element.

A household appliance device which has an appliance body with a wall element is already known from the prior art. The wall element is configured as a foam crossmember and partially delimits an isolation chamber. A fixing element which is provided for fixing at least one component to the wall element is integrally connected to the wall element. The fixing element is configured as an insertion groove. In an installed position, the fixing element protrudes in a direction facing the isolation chamber beyond a plane spanned by the wall element and is thus arranged inside the isolation chamber.

SUMMARY OF THE INVENTION

The object of the invention, in particular, is to provide a device of this type having improved properties in respect of assembly. The object is achieved according to the invention by the features described below, whilst advantageous embodiments and developments of the invention may be derived from the subclaims.

The invention is based on a household refrigeration device having at least one appliance body, which has at least one wall element which delimits at least one isolation chamber at least in part, and having at least one fixing element which is arranged on the wall element and is provided in order to fix at least one component to the wall element.

It is proposed that the fixing element protrudes in a direction facing away from the isolation chamber beyond a plane spanned by the wall element.

By means of the embodiment according to the invention, in particular, a generic device may be advantageously developed, in particular in respect of assembly and namely in particular regarding the safety of a user and/or regarding the compliance with at least one legal standard. In particular, a household appliance device which conforms to standards, advantageously a household refrigeration appliance which conforms to standards, may be provided. In particular, it is possible to dispense with a configuration of the component from a material which is of higher quality and/or fireproof, whereby in particular low costs and/or an economical design may be achieved. By dispensing with a fireproof material, in particular, low costs may be achieved and/or a use of halons which, in particular, are generally a component of fireproof materials may be avoided. In particular, a simple and/or rapid assembly of the component on the wall element and/or easy accessibility, in particular during assembly, may be permitted. An assembly of the component on the wall element may, in particular, be automated due to the easy accessibility and/or due to the fixing element protruding in the direction facing away from the isolation chamber beyond the plane spanned by the wall element, whereby in particular a short assembly time and/or low staffing costs may be achieved.

A "household appliance device", in particular a "household refrigeration appliance device" is intended to be understood, in particular, as at least one part, in particular a subassembly, of a household appliance, in particular of a household refrigeration appliance. In particular, the household appliance device may also comprise the entire household appliance, in particular the entire household refrigeration appliance. Particularly advantageously, a household appliance configured as a household refrigeration appliance is provided to refrigerate in at least one operating state refrigerated goods, in particular foodstuffs, such as for example beverages, meat, fish, milk and/or dairy products, in particular in order to achieve a longer shelf life of the refrigerated goods. The household appliance configured as a household refrigeration appliance may, in particular, be a refrigeration chest and advantageously an upright refrigerator and/or upright freezer. A household appliance comprising the household appliance device could alternatively be configured, for example, as a household cooking appliance, such as for example an oven and/or a cooker. In particular, in a household appliance configured as a household cooking appliance the isolation chamber could be arranged between a muffle and an outer wall of a household cooking appliance device of the household appliance.

The appliance body, in particular, defines at least one refrigerating zone at least in part. An "appliance body" is intended to be understood, in particular, as a unit which in at least one assembled state forms a part, in particular a large part, of an outer delimitation, in particular of a housing, advantageously of a household refrigeration appliance housing, and which in the assembled state defines a part, in particular a large part, of an outer delimitation of at least one refrigerating zone, in particular a cooling chamber and/or a freezing chamber. In particular, the appliance body has at least one housing element and, in particular at least two, advantageously at least three, particularly advantageously at least four, preferably at least five and particularly preferably at least six housing elements. The appliance body has, in particular, at least one side wall, in particular at least two side walls and/or at least one rear wall and/or at least one ceiling wall and/or at least one bottom wall which in at least one operating state together with the appliance door enclose the refrigerating zone and which are formed, in particular, by the housing elements.

In particular, the household refrigeration appliance device has at least one appliance door. An "appliance door" is intended to be understood, in particular, as a unit which in at least one assembled state is connected to the appliance body in a movable, and in particular pivotable, manner relative to the appliance body and which, in particular, in the assembled state forms a part of an outer delimitation, in particular of a housing, advantageously of a household refrigeration appliance housing. Advantageously, the appliance body and the appliance door in at least one assembled state form together the outer delimitation, in particular the housing, advantageously the household refrigeration appliance housing.

For example, the household refrigeration appliance device and, in particular, the appliance body could have the isolation chamber. An "isolation chamber" is intended to be understood, in particular, as a chamber which in at least one assembled state is filled at least in part and advantageously at least to a large part with at least one thermally isolating material, advantageously with at least one thermally isolating foam in order to ensure, in particular, a thermal decoupling between the refrigerating zone and the surroundings. In at least one assembled state the wall element is arranged at least partially in contact with the thermally isolating material. "At least to a large part" is intended to be understood, in particular, as a proportion, in particular a mass fraction and/or a volume fraction, of at least 70%, in particular of at least 80%, advantageously of at least 90% and preferably of at least 95%.

A "wall element" is intended to be understood, in particular, as an element which forms at least one portion of a wall delimiting the isolation chamber. For example, the wall element could form at least one portion of a side wall and/or a rear wall and/or a ceiling wall and/or a bottom wall of the appliance body. The wall element is configured, in particular, as a crossmember and advantageously as a foam crossmember and in at least one assembled state, in particular, connects at least two housing elements of the appliance body together, and namely in particular the side wall elements and/or at least one side wall element and at least one rear face. The wall element consists, in particular at least to a large part, of metal, in particular of sheet metal. In particular, the wall element is configured as a housing element. The isolation chamber is at least substantially and advantageously entirely defined and/or delimited, in particular, by the appliance body.

The wall element is configured, in particular, as a bottom wall delimiting the isolation chamber at least in part and/or as a ceiling wall delimiting a storage chamber at least in part. The storage chamber is configured, in particular, as a machinery compartment and is advantageously provided for storing refrigeration appliance components, such as for example a compressor and/or an electronics unit and/or a fan. In particular, the appliance body delimits the storage chamber at least in part. In particular, starting from a geometric center and/or center of gravity of the storage chamber, the storage chambers is, in particular, open and/or not delimited in at least one direction in order to permit and/or to ensure, in particular, an accessibility to the storage chamber. In an installed position the storage chamber, in particular at least to a large part, is arranged below the wall element, in particular below the plane spanned by the wall element.

In particular, the household appliance device has at least one refrigerant circuit which, in particular, has at least one evaporator and/or at least one compressor and/or at least one condenser. In particular, the household appliance device has at least one heating unit which, in particular, could be provided for heating at least one housing element in order to prevent, in particular at least substantially and advantageously entirely, the formation of condensate on the housing element and/or in order to remove, in particular at least substantially and advantageously entirely, condensate which has already been formed.

The phrase that the wall element delimits at least one isolation chamber "at least in part" is intended to be understood, in particular, that the wall element forms at least a portion of a delimitation, in particular a wall delimiting the isolation chamber, and for example could delimit the entire isolation chamber. Advantageously, the wall element delimits the isolation chamber together with the housing element, advantageously together with the housing elements. For example, the wall element could at least substantially and advantageously entirely delimit the isolation chamber and, in particular, form a wall entirely delimiting the isolation chamber. Alternatively, the wall element could at least substantially and advantageously entirely delimit the isolation chamber together with the housing element and/or with the housing elements and, in particular, together with the housing element and/or with the housing elements form an entire wall delimiting the isolation chamber.

A "fixing element" is intended to be understood, in particular, as an element which in at least one assembled state of the component produces a mechanical, in particular a non-positive and/or material and/or positive connection between the wall element and the component and which in at least one assembled state of the component fixes the component, in particular at least substantially, relative to the wall element. In at least one assembled state the fixing element, in particular, permits a movement of the component relative to the wall element by a maximum of 20 mm, in particular by a maximum of 10 mm, advantageously by a maximum of 5 mm, particularly advantageously by a maximum of 3 mm, preferably by a maximum of 1 mm and particularly preferably by a maximum of 0.5 mm. In particular, the household appliance device has the component.

The phrase that the fixing element is "arranged on the wall element" is intended to be understood, in particular, that the fixing element has a spacing from the wall element of a maximum of 20 mm, in particular of a maximum of 10 mm, advantageously of a maximum of 5 mm, particularly advantageously of a maximum of 3 mm, preferably of a maximum of 1 mm and particularly preferably of a maximum of 0.5 mm. The spacing between the wall element and the fixing element is, in particular, oriented at least substantially perpendicular to a surface of the wall element and/or the fixing element. In particular, the fixing element and the wall element are arranged at least partially in contact and/or at least partially touch one another. The expression "substantially perpendicular" is intended to define here, in particular, an orientation of a direction relative to a reference direction, wherein the direction and the reference direction, in particular when viewed in one plane, enclose an angle of 90° and the angle has a maximum deviation of in particular less than 8°, advantageously of less than 5° and particularly advantageously of less than 2°.

In at least one assembled state of the component, the fixing element fastens the component, in particular, to the wall element and, in particular, produces a mechanical connection between the component and the wall element. In particular, the wall element spans the plane which, in particular, in at least one assembled state is arranged facing the fixing element, with a proportion of at least 50%, in particular of at least 60%, advantageously of at least 70%, particularly advantageously of at least 80%, preferably of at least 90% and particularly preferably of at least 95% of a surface of the wall element. The direction facing away from the isolation chamber in which the fixing element, in particular, protrudes over the plane spanned by the wall element, is oriented, in particular, at least substantially perpendicular to the plane. In an installed position, the fixing element, in particular, is arranged at least to a large part below the wall element, in particular below the plane spanned by the wall element, and namely in particular in a region in which the fixing element is arranged on the wall element. The fixing element is arranged, in particular at least to a large part, inside the storage chamber.

"Provided" is intended to be understood, in particular, as being specifically designed and/or equipped. An object being provided for a specific function is intended to be understood, in particular, that the object fulfils and/or performs this specific function in at least one use state and/or operating state.

It is further proposed that the fixing element defines and/or delimits at least in part a receiving region which is provided for receiving at least one partial region of the component. In at least one assembled state of the component, in particular, at least one partial region of the component is arranged inside the receiving region. In particular, the partial region is arranged in at least one assembled state of the component positively and/or non-positively inside the partial region. The phrase that the fixing element defines at least one object, in particular at least one receiving region and/or at least one latching element, "at least in part" is intended to be understood, in particular, that the fixing element defines and/or delimits the object alone and/or that the fixing element defines and/or delimits the object together with at least one further element, advantageously together with the wall element. In particular, the fixing element defines the receiving region, in particular when viewed in a cross-sectional plane perpendicular to a longitudinal direction of extent of the fixing element, relative to a geometric center and/or center of gravity of the receiving region over an angular range of at least 90°, in particular of at least 120°, advantageously of at least 150° and preferably of at least 180°. The fixing element forms, in particular when viewed in a cross-sectional plane perpendicular to a longitudinal direction of extent of the fixing element, in particular at least one and advantageously at least two delimiting walls which define the receiving region at least in part. In particular, the wall element, in particular when viewed in a cross-sectional plane perpendicular to a longitudinal direction of extent of the fixing element, forms at least one delimiting wall which delimits the receiving region at least in part. A "longitudinal direction of extent" of an object is intended to be understood, in particular, as a direction which is oriented parallel to a longest side of a smallest imaginary geometric cuboid which just fully encloses the object. As a result, in particular, a stable fixing of the component to the wall element may be achieved and advantageously produced in a manner The receiving region is non-delimited and/or open, in particular toward at least one side, in particular when viewed in a cross-sectional plane perpendicular to a longitudinal direction of extent of the fixing element. Preferably, the receiving region is open in an assembly direction which is oriented at least substantially parallel to the plane and which, in particular, is provided for assembling the component on the wall element and into which the component is moved, in particular when assembled on the wall element. In particular, the assembly direction is oriented at least substantially parallel to a side wall of the appliance body and/or to a ceiling wall of the appliance body and/or to a bottom wall of the appliance body. The assembly direction, in particular starting from the fixing element, in particular from any point of the fixing element, faces in the direction of a plane spanned by an outer face of the wall element. In particular, the outer face of the wall element in at least one installed position is arranged so as to be visible to a user and/or is arranged on a side facing away from the isolation chamber and/or the refrigerating zone. The receiving region, in particular starting from the L-shape of the fixing element, is open in the direction of an outer face of the wall element. Alternatively the receiving region, in particular starting from an outer face of the wall element, could be open in the direction of the L-shape of the fixing element. In particular, the fixing element could define, at least in part, at least one second receiving region which, in particular, could be provided for receiving at least one second partial region of the component. The receiving region and the second receiving region could, in particular, be open in the same direction or in different directions which, in particular, could be oriented at least substantially anti-parallel to one another. "Substantially parallel" is intended to be understood here, in particular, as an orientation of a direction relative to a reference direction, in particular in one plane, wherein the direction relative to the reference direction has a deviation in particular of less than 8°, advantageously of less than 5°, and particularly advantageously of less than 2°. For example, in at least one cross-sectional plane which is oriented at least substantially perpendicular to a longitudinal direction of extent of the fixing element, the fixing element could have an L-shape, by means of which the fixing element could define and/or delimit the receiving region, in particular at least in part. As a result, in particular, a simple and/or uncomplicated assembly and/or an easy accessibility may be achieved. In particular, a linear assembly of the component may be permitted in an assembly direction from a rear face of the appliance body.

For example, the fixing element could fix the component on the wall element, exclusively by receiving the partial region in the receiving region. Preferably, the fixing element defines and/or delimits, at least in part, at least one latching element which is arranged, in particular, spaced apart from the receiving region, and is provided for latching the component to the wall element. The latching element and the receiving region are, in particular, spaced apart from one another, in particular by at least one wall of the fixing element which, in particular, is defined by at least one limb of the L-shape of the fixing element, and in particular are arranged relative to the assembly direction in particular on opposing sides of the wall of the fixing element. In particular, the fixing element defines and/or delimits at least one latching projection behind which, in particular, at least one latching element of the component corresponding to the latching element of the fixing element engages and/or latches in at least one assembled state of the component. The component has, in particular, at least one latching element corresponding to the latching element of the fixing element. In particular, the component has at least one component base body on which the latching element of the component is arranged, in particular, and relative to which at least one portion of the latching element of the component is, in particular, movably arranged. As a result, in particular, a rapid fixing of the component on the wall element may be permitted in a simple manner In particular, the component may be released from at least one assembled state of the component in a simple and/or uncomplicated manner without causing damage, whereby in particular easy maintenance and/or an environmentally friendly design may be achieved, and namely in particular by avoiding disposal as a result of damage to the component during dismantling.

For example, the fixing element could be configured separately from the wall element and, in particular, connected by means of at least one non-positive and/or positive and/or material connection to the wall element. Preferably, the fixing element is connected integrally to the wall element, whereby in particular a small stock inventory may be achieved. "Integrally" is intended to be understood, in particular, as at least connected by a material connection, for example by a welding process, a bonding process, an injection-molding process, and/or a further process which appears expedient to the person skilled in the art and/or understood to be advantageously formed in one piece, such as for example by a production from a casting and/or by a production in a single-component or multi-component injection-molding method and advantageously from a single blank. It is conceivable, in particular, that the wall element is produced by sheet metal forming and that at the same time the fixing element is integrally configured therewith. The fixing element may be configured, in particular, as a rollformed part and, in particular, by roll-forming of the wall element. As a result, in particular, a high degree of stability may be achieved.

The fixing element could, for example, extend over at least 1%, in particular over at least 2%, advantageously over at least 3%, particularly advantageously over at least 4% and preferably over at least 5% of an extent of the wall element parallel to a width extent of the appliance body. For example, the fixing element could extend over a maximum of 40%, in particular over a maximum of 30%, advantageously over a maximum of 20%, particularly advantageously over a maximum of 15%, preferably over a maximum of 12%, and particularly preferably over a maximum of 10% of an extent of the wall element parallel to a width extent of the appliance body. Preferably the fixing element extends over at least 50%, in particular over at least 60%, advantageously over at least 70%, particularly advantageously over at least 80%, preferably over at least 90% and particularly preferably over at least 95% of an extent of the wall element parallel to a width extent of the appliance body. In particular, the fixing element has an elongated design, in particular oriented in the direction of a longitudinal direction of extent of the fixing element, and is in particular configured as a support rail. A "width extent" of the appliance body is intended to be understood in this connection, in particular with a projection of the appliance body onto a plane spanned by a rear wall of the appliance body, in particular as a length of a second longest side of a smallest imaginary geometric cuboid which just fully encloses the appliance body. The width extent of the appliance body and/or the extent of the wall element are, in particular, oriented at least substantially perpendicular to the assembly direction. In particular, the width extent of the appliance body and/or the extent of the wall element, in particular, are oriented at least substantially perpendicular to a longitudinal direction of extent of the fixing element. As a result, the component may be fixed to the wall element, in particular at any location along the width extent of the appliance body, whereby in particular a high degree of flexibility may be achieved.

It is further proposed that the household appliance device has at least one marking unit which is provided for marking and/or identifying and/or highlighting an assembly position of the component on the fixing element. In particular, the marking unit is arranged on the fixing element and, in particular, integrally connected to, and advantageously configured on, the fixing element. The marking unit could, for example, be connected to the wall element by means of at least one coating and/or painting and/or engraving and/or embossing. Alternatively or additionally, the marking unit could be configured as a recess and/or as a projection on the fixing element. Advantageously, the marking unit is defined by at least one recess and, in particular, by at least two, advantageously by at least four, particularly advantageously by at least eight and preferably by at least twelve recesses which are arranged in particular on the fixing element. As a result, the component may be fixed, in particular, accurately at a desired and/or optimal assembly position on the wall element, whereby a high degree of functional efficiency may be achieved. In particular, mass production may be permitted in a simple manner, in which, in particular, components may be arranged at the same assembly positions and/or a uniform overall view may be achieved.

For example, the household appliance device could, in particular, exclusively have the fixing element which, in particular, could fix the component to the wall element on its own, advantageously avoiding at least one further fixing element. Preferably, the household appliance device has at least one further fixing element which protrudes in a direction facing away from the isolation chamber beyond the plane spanned by the wall element. As a result, in particular, a particularly stable fixing of the component to the wall element may be achieved.

The fixing element and the further fixing element could be arranged, for example, in an installed position at the same height relative to a vertical direction and, in particular, have at least substantially the same spacing from a positioning surface. In particular, a household refrigeration appliance having the appliance body and/or a household refrigeration appliance having the household appliance device could be positioned on the positioning surface. The positioning surface could be defined, in particular, by at least one bottom surface and/or by at least one floor. Preferably, in an installed position the fixing element and the further fixing element are arranged offset relative to a vertical direction, at least in part. The fixing element, in particular a side of the fixing element facing away from the isolation chamber, and the further fixing element, in particular a side of the fixing element facing away from the isolation chamber, have in particular various and/or different spacings from the positioning surface. For example, the fixing element, in particular a side of the further fixing element facing away from the isolation chamber, could have a greater spacing from the positioning surface than the further fixing element, in particular than the side of the further fixing element facing away from the isolation chamber. Alternatively, the fixing element, in particular a side of the further fixing element facing away from the isolation chamber, for example, could have a smaller spacing from the positioning surface than the further fixing element, in particular than the side of the further fixing element facing away from the isolation chamber. The plane spanned by the wall element, in particular, is oriented obliquely relative to the positioning surface and encloses with the positioning surface, in particular, a smallest angle of at least 3°, in particular of at least 5°, advantageously of at least 7°, particularly advantageously of at least 9° and preferably of at least 10°. In particular, the plane spanned by the wall element, encloses with the positioning surface a smallest angle of a maximum of 40°, in particular a maximum of 35°, advantageously a maximum of 30°, particularly advantageously a maximum of 25° and preferably a maximum of 20°. The phrase that in an installed position the fixing element and the further fixing element are arranged offset relative to a vertical direction "at least in part" is intended to be understood, in particular, that at least a first of the fixing elements has a partial region which in an installed position could be arranged without overlap with a second of the fixing elements relative to a vertical direction, wherein in an installed position the first fixing element, in particular, could also be arranged entirely without overlap with the second fixing element relative to a vertical direction. As a result, in particular, a particularly advantageous and/or simple fixing of the component to the wall element may be possible.

In particular, the fixing element and the further fixing element are arranged spaced apart from one another in the assembly direction. The fixing element has, in particular, a smaller spacing from the outer face of the wall element than the further fixing element. Alternatively, the further fixing element, in particular, could have a smaller spacing from the outer face of the wall element than the fixing element.

It is further proposed that the fixing element and the further fixing element are oriented and/or arranged at least substantially parallel to one another, whereby in particular a stable design may be achieved.

It is further proposed that the further fixing element defines at least one further receiving region which is provided for receiving at least one further partial region of the component. For example, the receiving region and the further receiving region could be open in the same direction. Alternatively, the receiving region and the further receiving region, in particular, could be open in different directions which, in particular, could be oriented at least substantially anti-parallel to one another. As a result, in particular, a high level of stability may be achieved.

It is further proposed that the household appliance device has the component which is configured as a housing unit, in particular as a fan housing unit and, in particular, defines and/or delimits, at least in part, at least one receiving space for receiving at least one object. A "housing unit" is intended to be understood, in particular, as a unit which is provided in the assembled state to delimit and/or define, at least in part, at least one receiving space which is configured, in particular, as a hollow space for receiving and/or mounting at least one object. The receiving space is, in particular, configured as a hollow space. The housing unit in the assembled state, in particular, receives at least to a large part a weight force of at least one object which is arranged, in particular, at least to a large part inside the receiving space and/or transmits the weight force to at least one further unit, such as for example to the positioning surface and/or to the fixing element and/or to the wall element. In particular, the household appliance device has at least one fan unit which in at least one assembled state of the component is arranged inside the receiving space. As a result, in particular, an embodiment may be achieved which has a long service life and which is convenient, since in particular at least one object arranged inside the receiving space may be safely stored.

It is further proposed that the component has at least one latching element which is provided for latching to the fixing element. In particular, the component has at least one further latching element, in particular in addition to the latching element. The latching element is provided, in particular, for latching to the fixing element and in at least one assembled state of the component, in particular, is latched on the fixing element and/or to the fixing element. The further latching element is provided, in particular, for latching to the further fixing element and in at least one assembled state of the component, in particular, is latched on the further fixing element and/or to the further fixing element. As a result, in particular, a flexible design may be achieved and/or a connection which is releasable without the use of tools may be achieved between the component and the fixing element.

In at least one assembled state of the component, the component could be fixed, for example, captively and/or permanently and/or inseparably to the wall element, avoiding damage. Preferably, the component has at least one dismantling element which is provided for dismantling the component from the fixing element. In particular, the dismantling element is configured as a recess and provides for an insertion of at least one dismantling tool which, in particular, is provided for the release of the latching element of the component from a latched position. In the latched position, the component, in particular, is latched to the fixing element and the latching element of the component, in particular, engages behind the latching element of the fixing element. The component has, in particular, at least one actuating element which is arranged, in particular, on the latching element of the component and, in particular, according to an actuation of the actuating element is provided for the release of the latching element from the latched position. In particular, the actuating element has at least one actuating recess into which, in particular, the dismantling tool may be inserted for releasing the latched position. The actuating element moves the latching element, in particular, from the latched position according to a rotational movement of the dismantling tool engaging in the dismantling element and the actuating recess. As a result, in particular, a dismantling of the component by a fitter and/or customer service employee may be permitted and at the same time a dismantling by a user may be made difficult, whereby in particular a high level of convenience and/or a high level of safety may be achieved for the user.

The fixing element and/or the further fixing element could, for example, be provided for fixing at least one further component, in particular the household appliance device, to the wall element. The further component could, for example, be at least one evaporation pan and/or at least one operating capacitor and/or at least one solenoid valve and/or at least one electronic unit. In particular, when fixing the component and/or the further component to the wall element, the fixing element and/or the further fixing element could be provided for an electrical contact of the component and/or the further component and namely, in particular, automatically and advantageously when reaching an end position of the component and/or the further component on the wall element.

A particularly advantageous embodiment may be achieved, in particular, by a household appliance, in particular by a household refrigeration appliance, having at least one household appliance device.

The household appliance device in this case is not intended to be limited to the above-described use and embodiment. In particular, for fulfilling a mode of operation described herein the household appliance device may have a number of individual elements, components and units which deviates from the number cited herein.

Further advantages are disclosed from the following description of the drawings. Exemplary embodiments of the invention are shown in the drawings. The drawings, the description and the claims contain numerous features in combination. The person skilled in the art will also expediently consider the features individually and combine them to form further meaningful combinations.

DETAILED DESCRIPTION OF THE INVENTION

Figure 1:
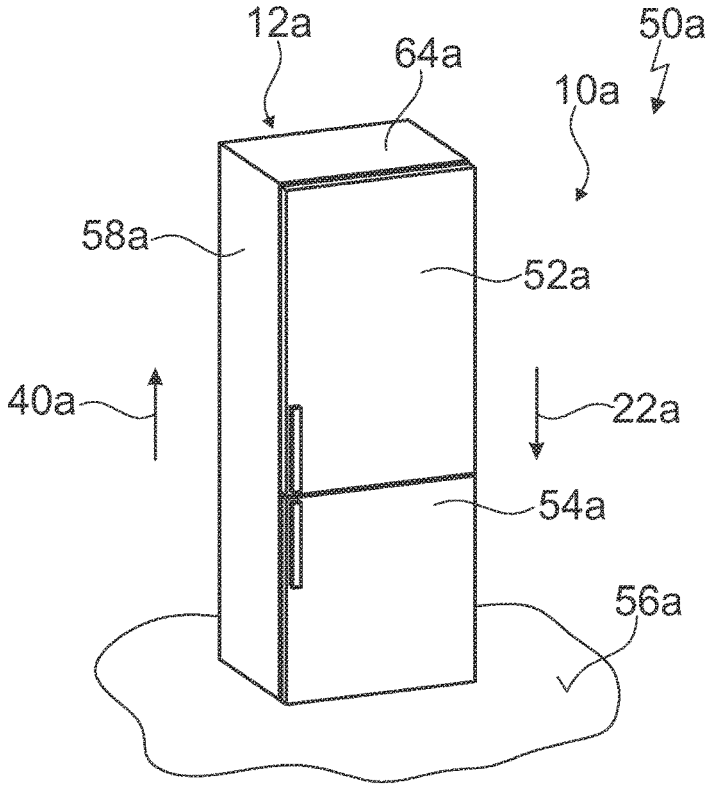
FIG. 1 shows a household refrigeration appliance with a household appliance device in a schematic perspective view.

FIG. 1 shows a household appliance 50*a* which is configured as a household refrigeration appliance in a closed state. The household refrigeration appliance 50*a* is configured as a refrigerator appliance and as a freezer appliance, in particular as a combined-fridge-freezer appliance. The household appliance 50*a* has a household appliance device 10*a* which is configured as a household refrigeration appliance device. The household appliance device 10*a* has an appliance body 12*a*.

The appliance body 12*a* partially defines a refrigerating zone (not shown). The refrigerating zone is configured as a cooling chamber. The household appliance device 10*a* has an appliance door 52*a*. The appliance door 52*a* is pivotably mounted relative to the appliance body 12*a*. In a closed state, the appliance door 52*a* closes the refrigerating zone.

The appliance body 12*a* partially defines a further refrigerating zone (not shown). The further refrigerating zone is configured as a freezer chamber. The household appliance device 10*a* has a further appliance door 54*a*. The further appliance door 54*a* is pivotably mounted relative to the appliance body 12*a*. In a closed state, the further appliance door 54*a* closes the further refrigerating zone. In an installed position, the further refrigerating zone is arranged below the refrigerating zone relative to a vertical direction 40*a*. In an installed position, the appliance body 12*a* is positioned on a positioning surface 56*a*. The positioning surface 56*a* in the present exemplary embodiment is a floor, in particular of a room of a house.

Figure 2:
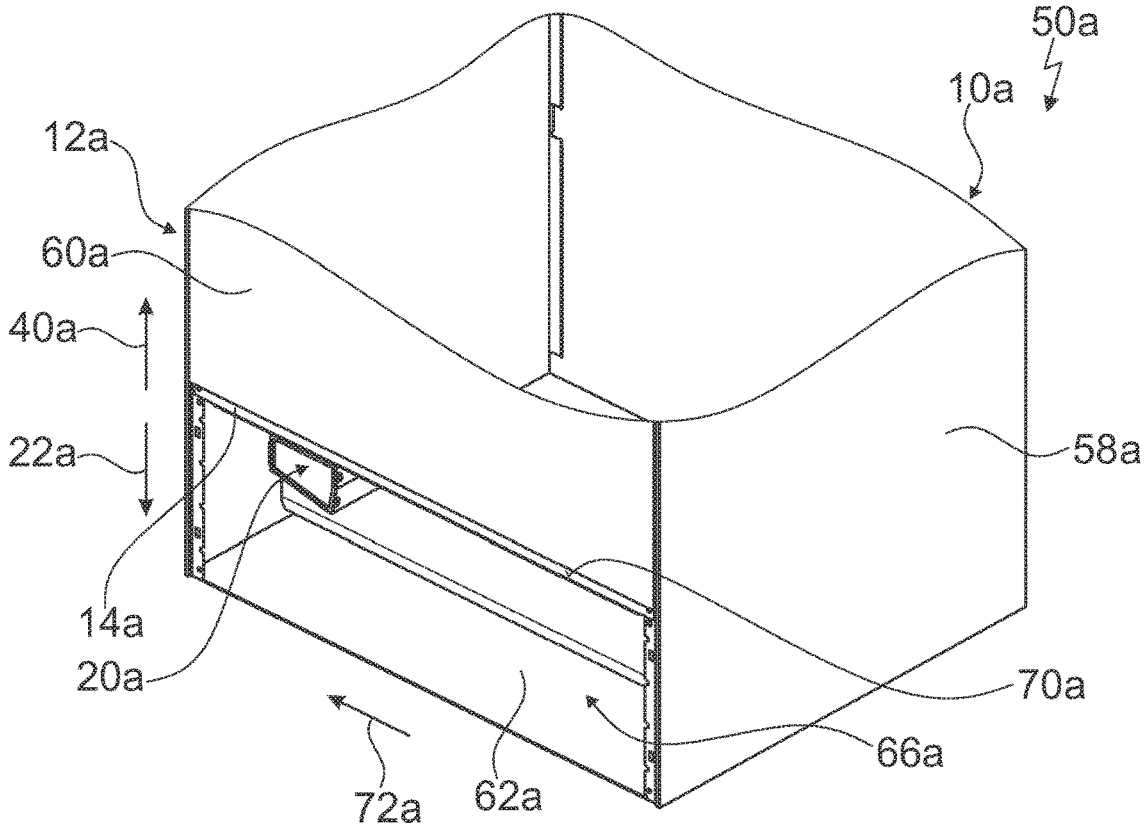
FIG. 2 shows a detail of the household refrigeration appliance with the household appliance device in a perspective view.
Figure 3:
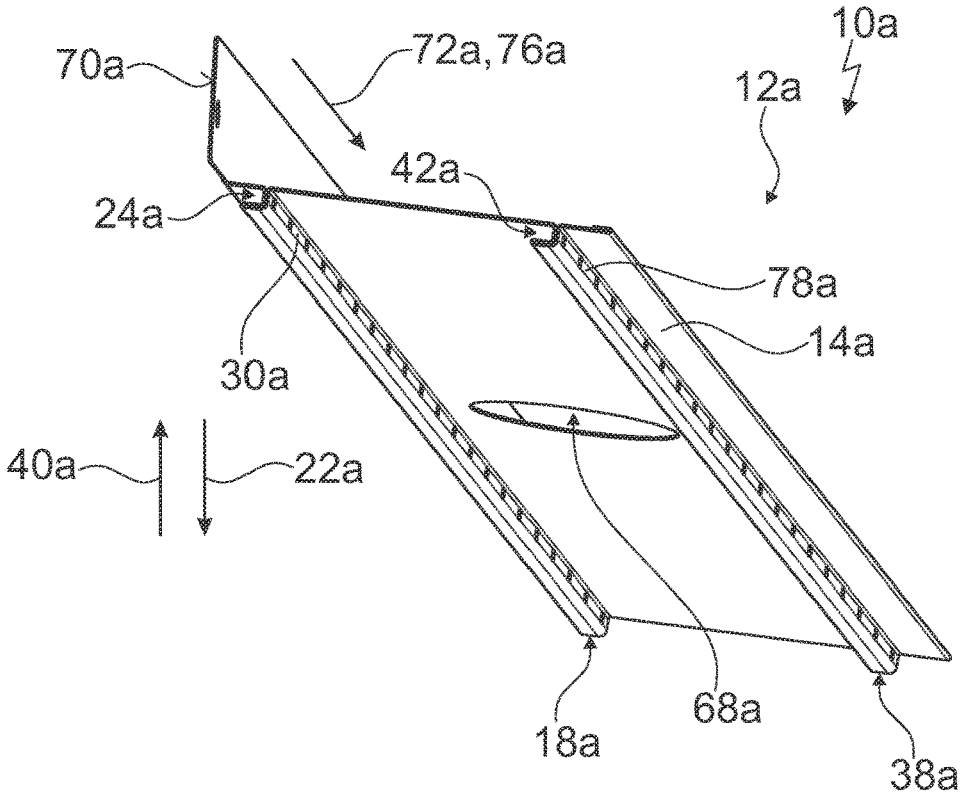
FIG. 3 shows a wall element, a fixing element and a further fixing element of the household appliance device in a perspective view obliquely from below.
Figure 4:
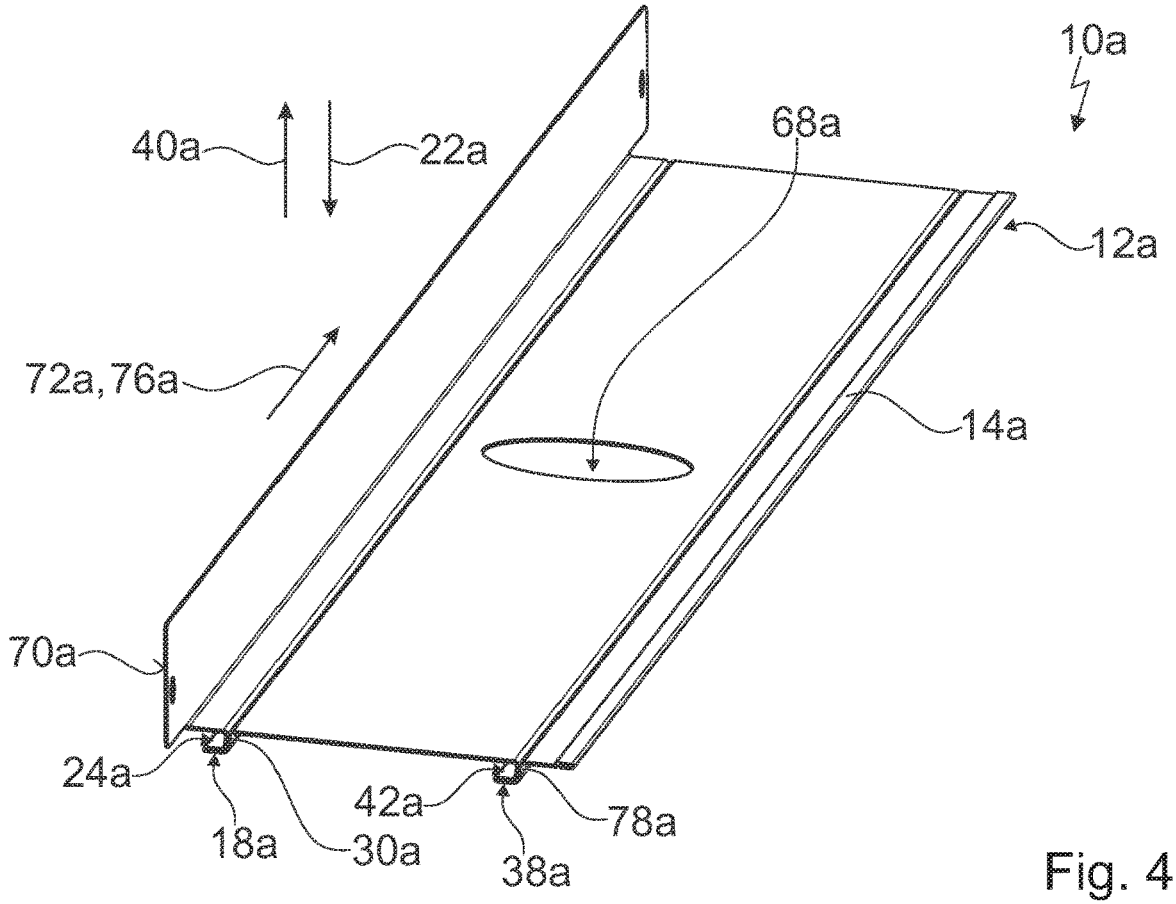
FIG. 4 shows the wall element, the fixing element and the further fixing element in a perspective view obliquely from above.
Figure 5:
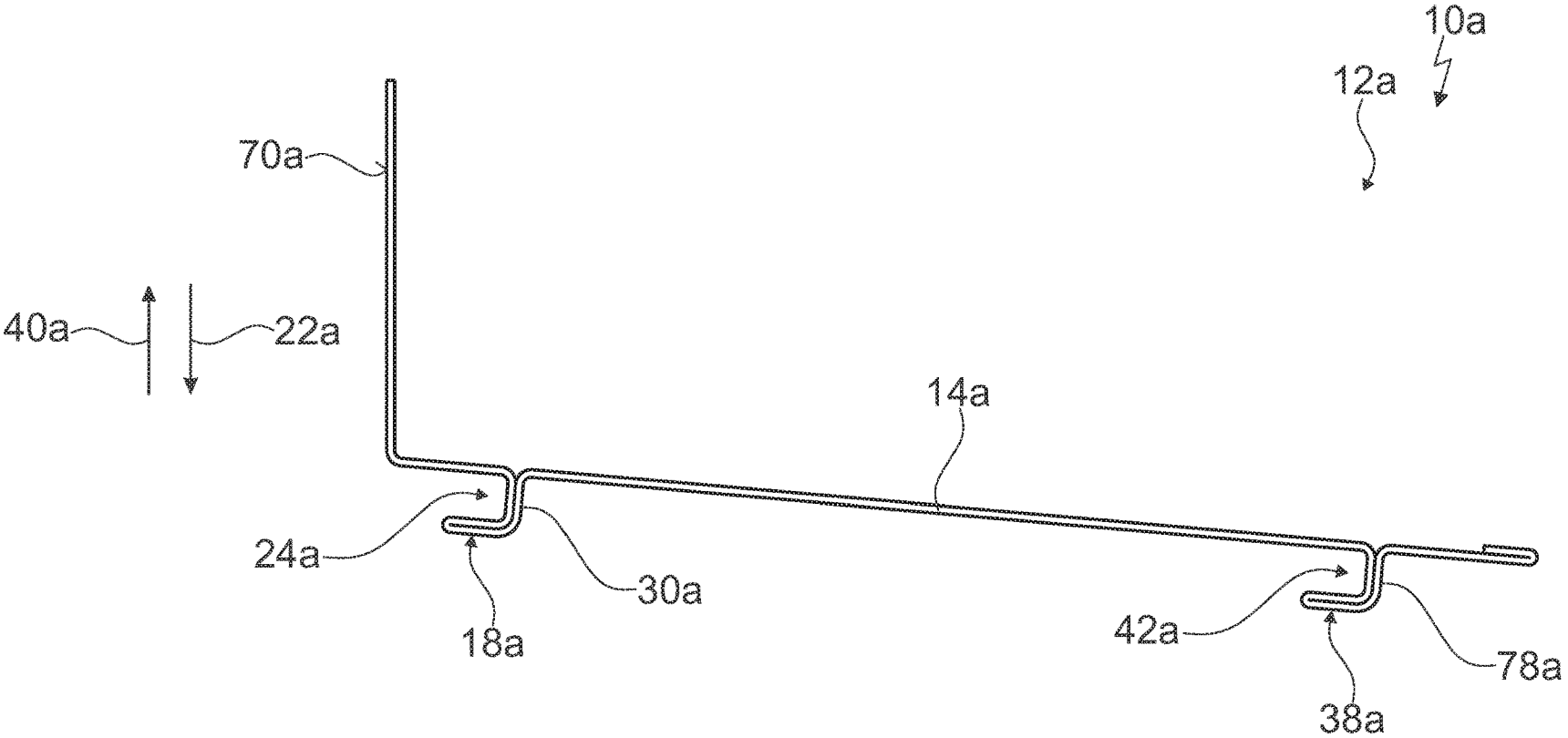
FIG. 5 shows the wall element, the fixing element and the further fixing element in a partial sectional view.

The appliance body 12*a* has two side walls 58*a*, a rear wall 60*a*, a ceiling wall 64*a* and a bottom wall 62*a* (see also FIG. 2). The appliance body 12*a* has a wall element 14*a*. The wall element 14*a* is configured as a foam crossmember. The wall element 14*a* has a foaming recess 68*a* (see FIGS. 3 and 4). The foaming recess 68*a* is provided for introducing isolation material into an isolation space 16*a*.

Figure 12:
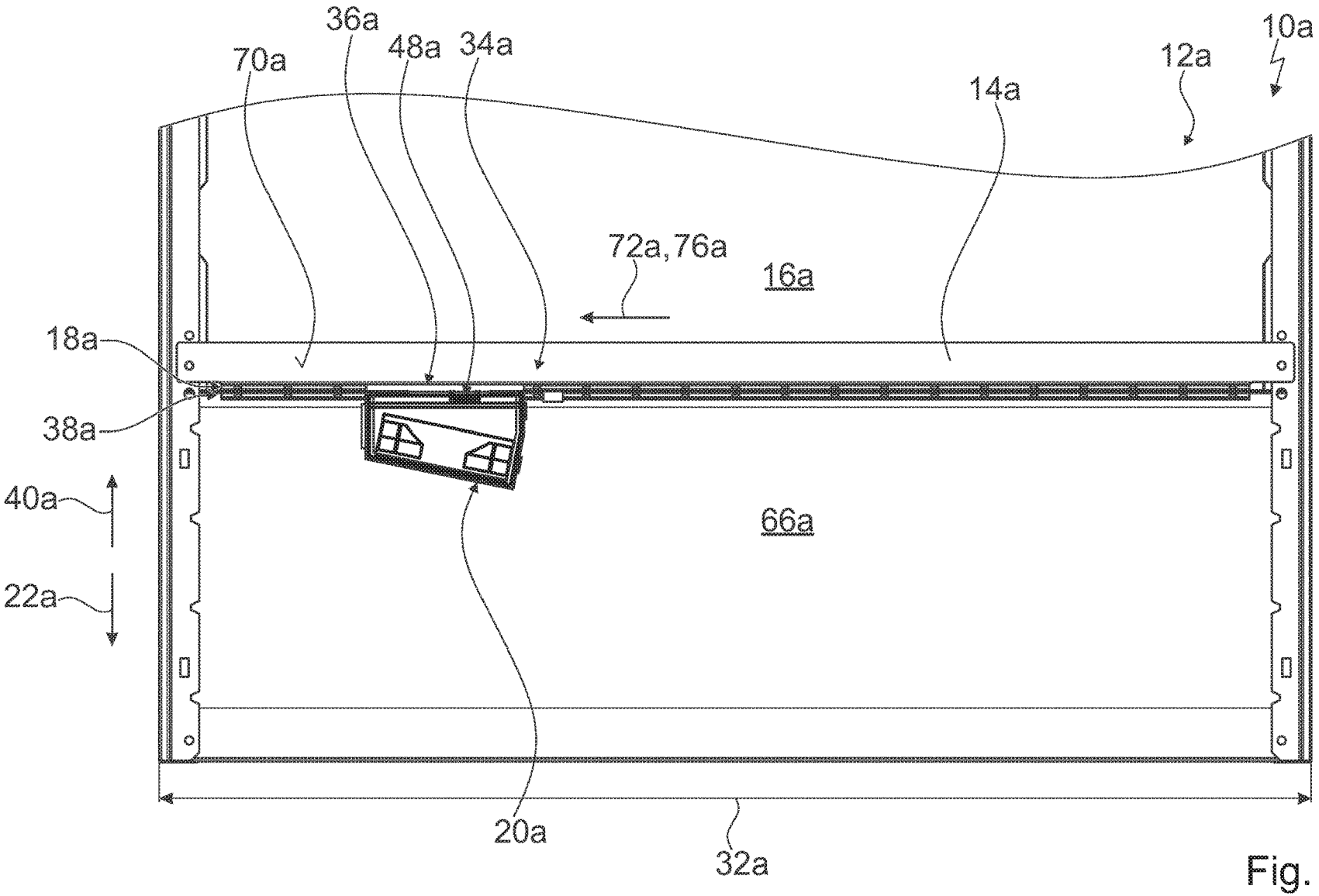
FIG. 12 shows a detail of the household refrigeration appliance with the household appliance device in a view having a viewing direction parallel to an assembly direction.
Figure 13:
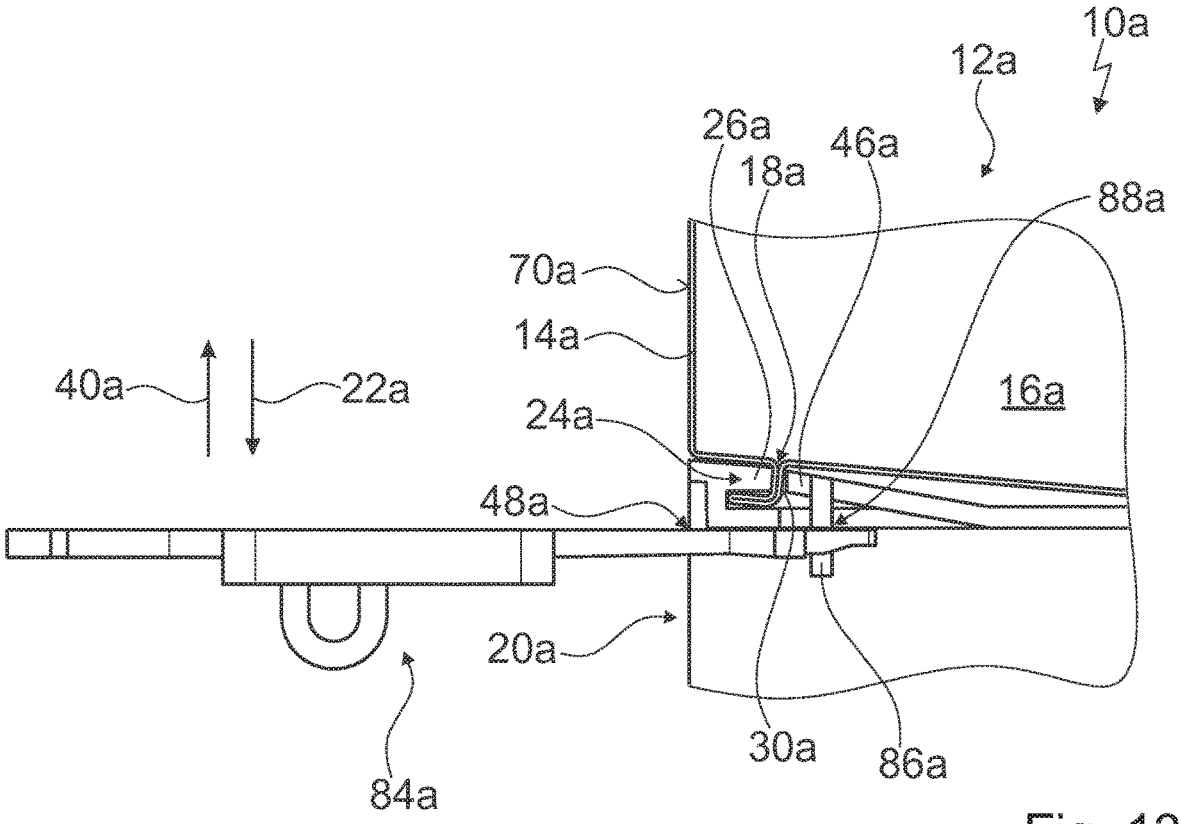
FIG. 13 shows the wall element, the fixing element, the further fixing element and the component in a dismantling step in a partial sectional view.

The wall element 14*a* partially delimits an isolation space 16*a* (see FIGS. 12 and 13). In addition to the wall element 14*a*, the side walls 58*a*, the rear wall 60*a*, the ceiling wall 64*a* and the bottom wall 62a partially delimit the isolation chamber in each case. In an assembled state, the wall element 14*a* partially delimits a machinery compartment 66*a*. The wall element 14*a* partially defines a ceiling wall of the machinery compartment 66*a*.

The household appliance device 10*a* has a fixing element 18*a* (see FIGS. 3 to 13). The fixing element 18*a* is arranged on the wall element 14*a*. In an installed position, the fixing element 18*a* is arranged on a lower face of the wall element 14*a* relative to a vertical direction 40*a*. In the present exemplary embodiment, the fixing element 18*a* is integrally connected to the wall element 14*a*.

The fixing element 18*a* is provided for fixing a component 20*a* to the wall element 14*a*. The household appliance device 10*a* has the component 20*a*. The component 20*a* is configured as a housing unit. In the present exemplary embodiment, the component 20*a* is configured as a fan housing unit.

In an assembled state of the component 20*a* the fixing element 18*a* fixes the component 20*a* to the wall element 14*a*. The wall element 14*a* spans a plane with a large part of a surface facing away from the isolation chamber 16*a*. The fixing element 18*a* protrudes in a direction 22*a* facing away from the isolation space 16*a* beyond the plane spanned by the wall element 14*a* (see FIGS. 3 to 13). The direction 22*a* in which the fixing element 18*a* protrudes beyond the plane spanned by the wall element 14*a* is oriented substantially anti-parallel to the vertical direction 40*a*.

The fixing element 18*a* partially defines a receiving region 24*a*. The receiving region 24*a* is provided for receiving a partial region 26*a* of the component 20*a* (see FIGS. 8 to 11 and 13). In an assembled state, the receiving region 24*a* receives the partial region 26*a* of the component 20*a*. In an assembled state the partial region 26*a* of the component 20*a* is arranged inside the receiving region 24*a*.

The receiving region 24*a* is open toward an outer face 70*a* of the wall element 14*a*. The outer face 70*a* of the wall element 14*a* defines a part of a rear face of the appliance body 12*a*. Together with the rear wall 60*a* of the appliance body 12*a* the outer face 70*a* of the wall element 14*a* substantially defines the rear face of the appliance body 12*a* (see FIG. 2). The receiving region 24*a* is open in an assembly direction 28*a* which is oriented substantially parallel to the plane (see FIGS. 8 to 11 and 13).

The fixing element 18*a* partially defines a latching element 30*a*. The latching element 30*a* is arranged on a side of a wall of the fixing element 18*a* opposing the receiving region 24*a*, in particular relative to the assembly direction 28*a*. The fixing element 18*a* is provided by means of the latching element 30*a* for latching the component 20*a* to the wall element 14*a*.

In a cross-sectional plane which is oriented substantially perpendicular to a longitudinal direction of extent 72*a* of the fixing element 18*a*, the fixing element 18*a* has an L-shape. The fixing element 18*a* extends in the present exemplary embodiment over substantially 95% of an extent of the wall element 14*a* parallel to a width extent 32*a* of the appliance body 12*a* (see FIG. 12). An extent of the fixing element 18*a* in the longitudinal direction of extent 72*a* of the fixing element 18*a* is substantially 95% of an extent of the wall element 14*a* parallel to a width extent 32*a* of the appliance body 12*a*.

Figure 6:
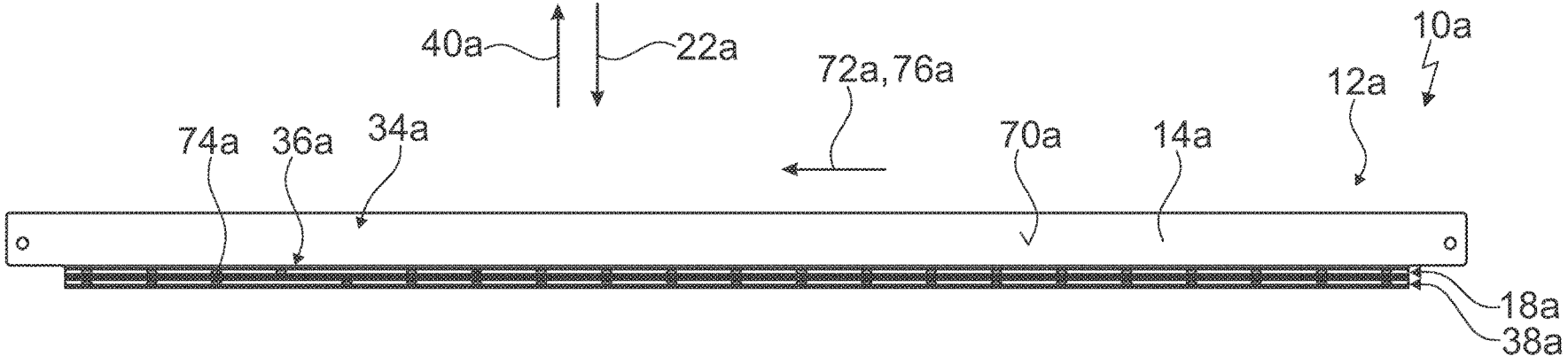
FIG. 6 shows the wall element, the fixing element and the further fixing element in a view having a viewing direction parallel to an assembly direction.
Figure 7:
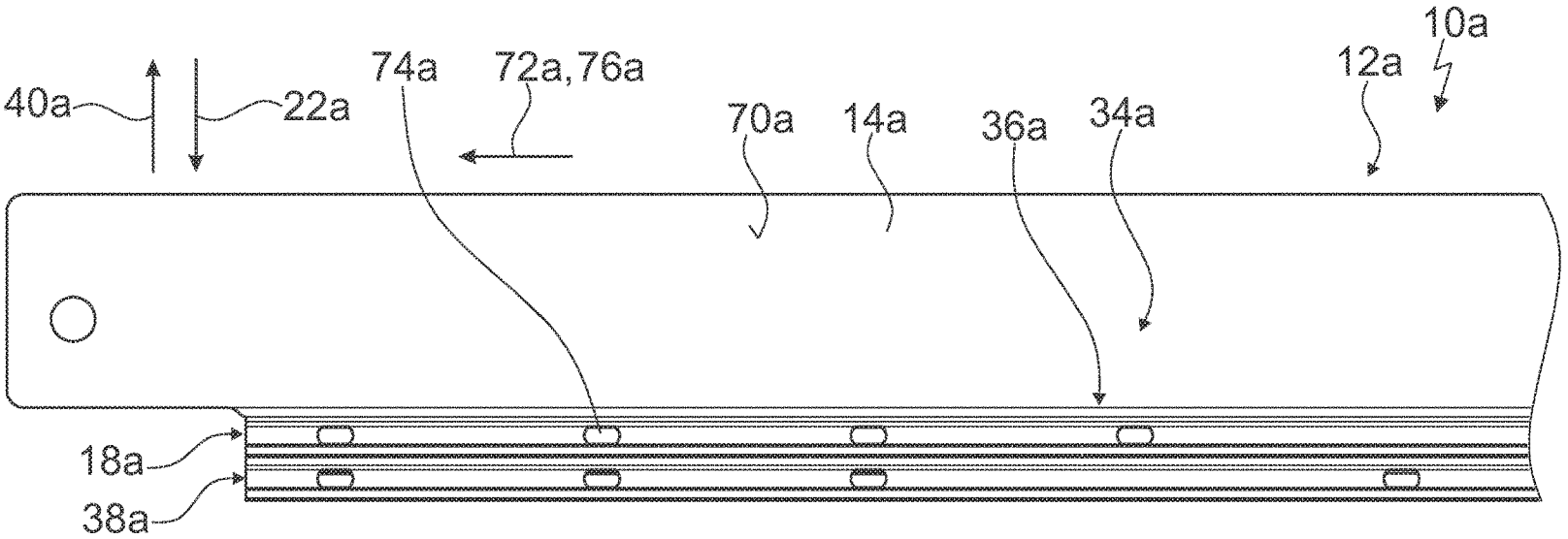
FIG. 7 shows an enlarged detail of FIG. 6.
Figure 8:
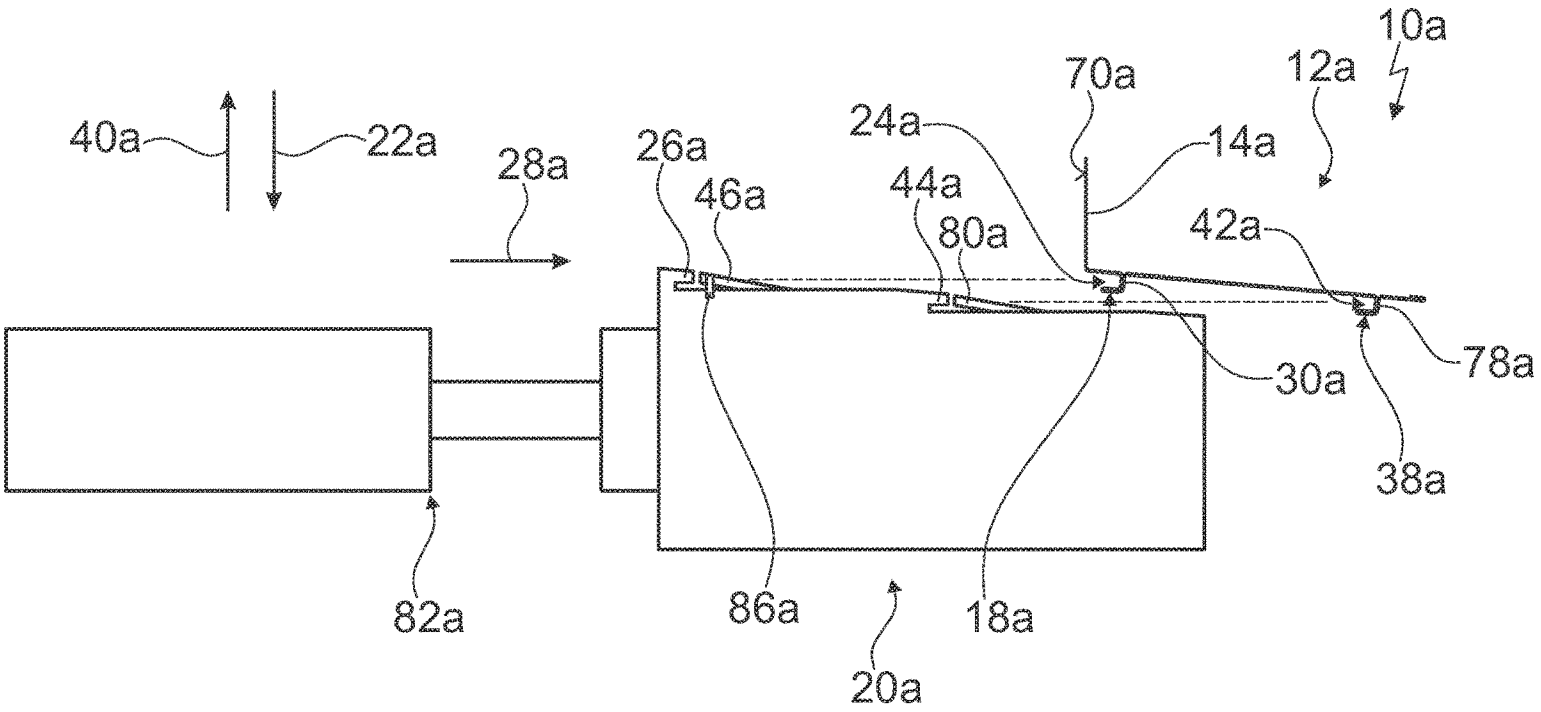
FIG. 8 shows the wall element, the fixing element, the further fixing element and a component of the household appliance device in an assembly step in a partial sectional view.
Figure 9:
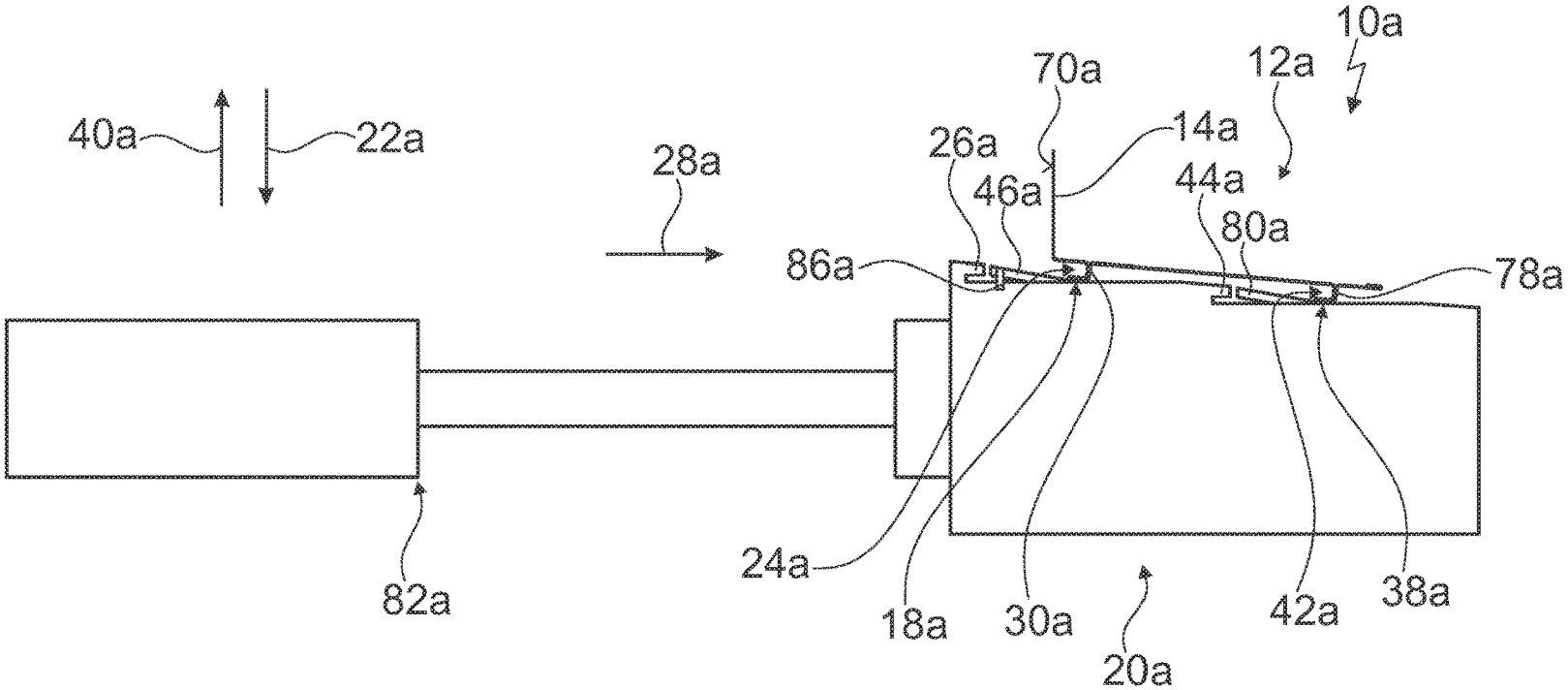
FIG. 9 shows the wall element, the fixing element, the further fixing element and the component in a further assembly step in a partial sectional view.
Figure 10:
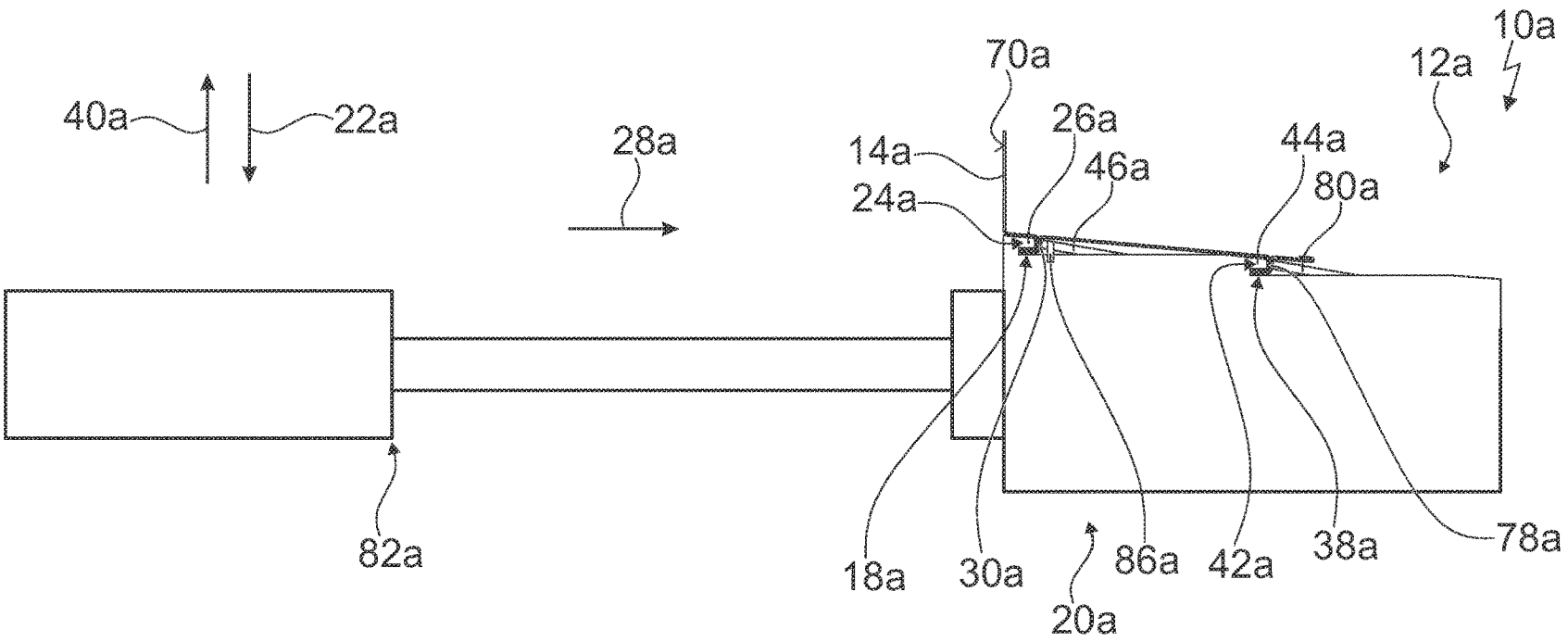
FIG. 10 shows the wall element, the fixing element, the further fixing element and the component in a further assembly step in a partial sectional view.
Figure 11:
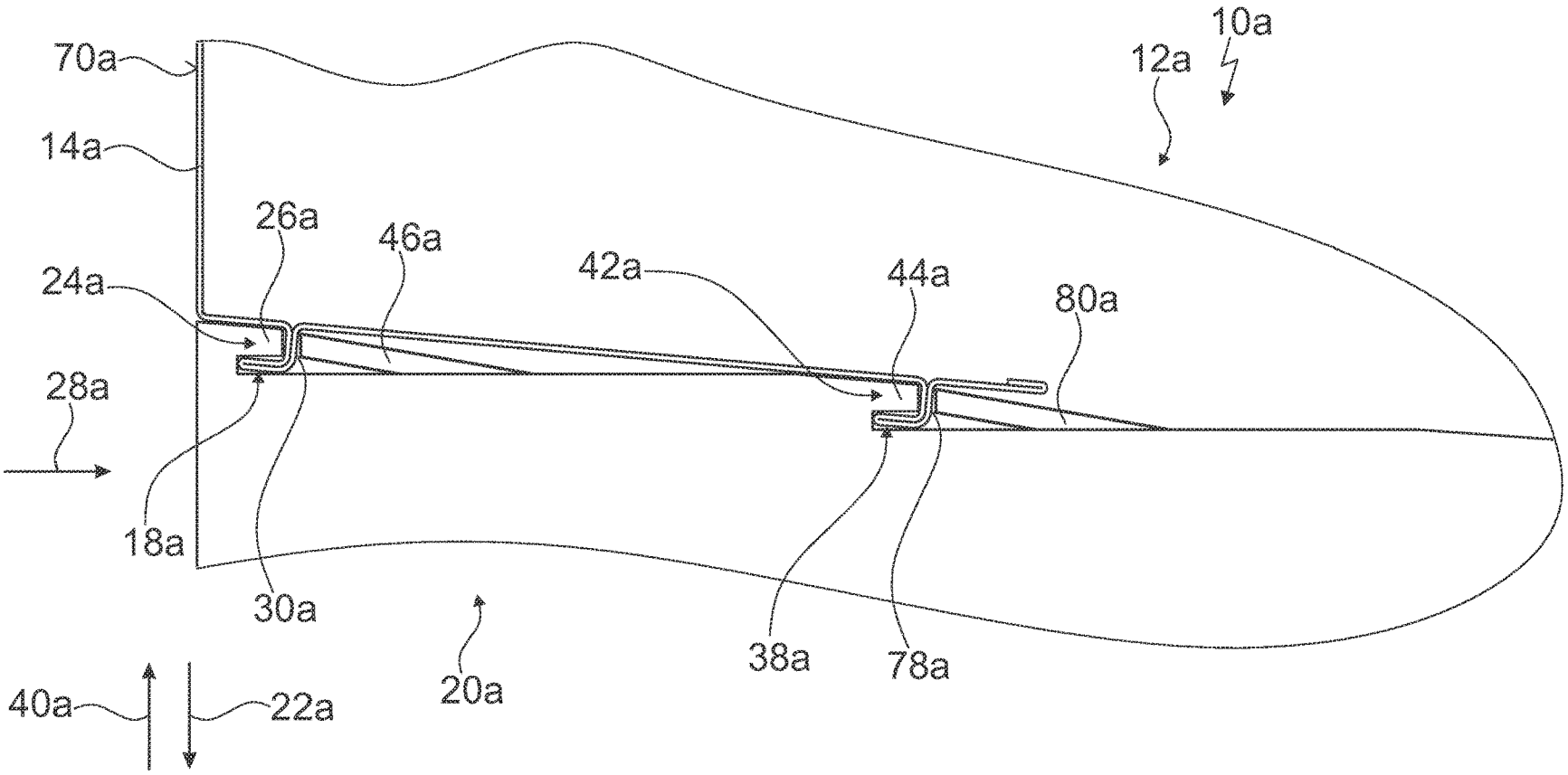
FIG. 11 shows the wall element, the fixing element, the further fixing element and the component in an assembled state in a partial sectional view.

The household appliance device 10*a* has a marking unit 34*a* (see FIGS. 6 and 7). The marking unit 34*a* is integrally connected to the fixing element 18*a*. The marking unit 34*a* is defined by a plurality of recesses 74*a*. The recesses 74*a*, by which the marking unit 34*a* is defined, are arranged on the fixing element 18*a*. The marking unit 34*a* marks an assembly position 36*a* of the component 20*a* on the fixing element 18*a*. The marking unit 34*a* marks an assembly position 36*a* by an arrangement of the recesses 74*a*.

In addition to the fixing element 18*a* the household appliance device 10*a* has a further fixing element 38*a*. The further fixing element 38*a* protrudes in a direction 22*a* facing away from the isolation space 16*a* beyond the plane spanned by the wall element 14*a* (see FIGS. 3 to 13). In an installed position the fixing element 18*a* is arranged above the further fixing element 38*a* relative to the vertical direction 40*a*. In an installed position the fixing element 18*a* and the further fixing element 38*a* are arranged partially offset relative to the vertical direction 40*a*.

The fixing element 18*a* and the further fixing element 38*a* are oriented substantially parallel to one another. In a cross-sectional plane which is oriented substantially perpendicular to a further longitudinal direction of extent 76*a* of the further fixing element 38*a*, the further fixing element 38*a* has an L-shape. The further fixing element 38*a* extends in the present exemplary embodiment over substantially 95% of an extent of the wall element 14*a* parallel to a width extent 32*a* of the appliance body 12*a* (see FIG. 12).

The further fixing element 38*a* is constructed substantially the same as the fixing element 18*a*. The further fixing element 38*a* partially defines a further receiving region 42*a*. The further receiving region 42*a* is provided for receiving a further partial region 44*a* of the component 20*a* (see FIGS. 8 to 11 and 13). In an assembled state, the further receiving region 42*a* receives the further partial region 44*a* of the component 20*a*. In an assembled state the further partial region 44*a* of the component 20*a* is arranged inside the further receiving region 42*a*.

The further receiving region 42*a* is open toward an outer face 70*a* of the wall element 14*a*. The further receiving region 42*a* is open in an assembly direction 28*a* which is oriented substantially parallel to the plane (see FIGS. 8 to 11 and 13).

The further fixing element 38*a* partially defines a further latching element 78*a*. The further latching element 78*a* is arranged on a side of a wall of the further fixing element 38*a* opposing the further receiving region 42*a*, in particular relative to the assembly direction 28*a*. The further fixing element 38*a* is provided for latching the component 20*a* to the wall element 14*a*, by means of the further latching element 78*a*.

The component 20*a* has a latching element 46*a* (see FIGS. 8 to 11 and 13). The latching element 46*a* of the component 20*a* is provided for latching to the fixing element 18*a*. In an assembled state of the component 20*a* the latching element 46*a* of the component 20*a* engages behind the latching element 30*a* of the fixing element 18*a*.

The component 20*a* has a further latching element 80*a* (see FIGS. 8 to 11). The further latching element 80*a* of the component 20*a* is provided for a latching to the further fixing element 38*a*, in particular to the further latching element 78*a* of the further fixing element 38*a*. In an assembled state of the component 20*a* the further latching element 80*a* of the component 20*a* engages behind the further latching element 78*a* of the further fixing element 38*a*.

In a method for assembling the household appliance device 10*a* the component 20*a* is fixed to the wall element 14*a* (see FIGS. 8 to 11). The component 20*a* is moved toward the wall element 14*a* in an assembly direction 28*a* and namely, in particular, by means of an assembly tool 82*a*. With a further movement of the component 20*a* in the assembly direction 28*a* the partial region 26*a* of the component 20*a* engages in the receiving region 24*a* of the fixing element 18*a* and/or the further partial region 80*a* of the component 20*a* engages in the further receiving region 42*a* of the further fixing element 38*a*.

The component 20*a* is moved further in the assembly direction 28*a*. The component 20*a* is moved sufficiently far in the assembly direction 28*a* toward the wall element 14*a* until the latching element 46*a* of the component 20*a* engages behind the latching element 30*a* of the fixing element 18*a* and/or until the further latching element 80*a* of the component 20*a* engages behind the further latching element 78*a* of the further fixing element 38*a* (see FIGS. 10 and 11). The assembly tool 82*a* is removed from the component 20*a* and namely, in particular, as soon as the component 20*a* is arranged in an assembled state of the component 20*a* (see FIG. 11).

The component 20*a* has a dismantling element 48*a* (see FIGS. 12 and 13). The dismantling element 48*a* is provided for dismantling the component 20*a* from the fixing element 18*a*. The dismantling element 48*a* is configured as a recess. The dismantling element 48*a* is provided for the insertion of at least one dismantling tool 84*a*. The dismantling tool 84*a* is provided for the release of the latching element 46*a* of the component 20*a* from a latched position.

The component has an actuating element 86*a* (see FIG. 13). The actuating element 86*a* is arranged on the latching element 46*a* of the component 20*a*. The actuating element 86*a* is provided, according to an actuation of the actuating element 86*a*, for the release of the latching element 46*a* of the component 20*a* from the latched position. The actuating element 86*a* has an actuating recess 88*a*. The dismantling tool 84*a* is able to be inserted into the actuating recess 88*a* for releasing the latched position. The actuating element 86*a* moves the latching element 46*a* of the component from the latched position according to a rotational movement of the dismantling tool 84*a* engaging in the dismantling element 48*a* and in the actuating recess 88*a*.

Figure 14:
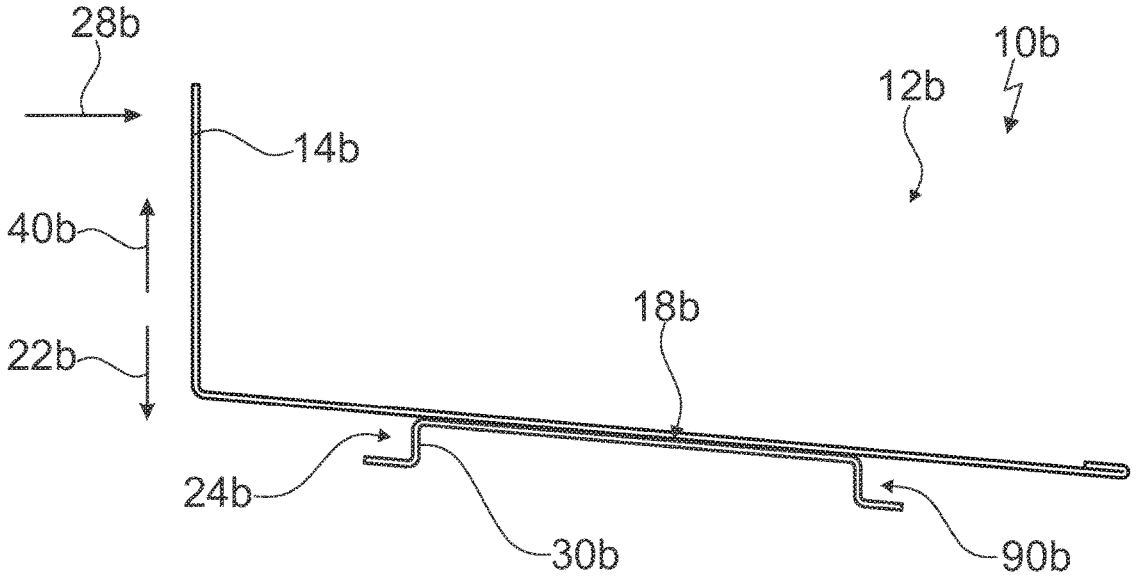
FIG. 14 shows a wall element and a fixing element of an alternative household appliance device in a partial sectional view.

In FIG. 14 a further exemplary embodiment of the invention is shown. The following descriptions are substantially limited to the differences between the exemplary embodiments, wherein reference may be made to the description of the exemplary embodiment of FIGS. 1 to 13 relative to the components, features and functions which remain the same. For differentiating between the exemplary embodiments, the letter a in the reference numerals of the exemplary embodiment in FIGS. 1 to 13 is replaced by the letter b in the reference numerals of the exemplary embodiment of FIG. 14. Relative to the components denoted the same, in particular relative to components with the same reference numerals, in principle reference may also be made to the drawings and/or the description of the exemplary embodiment of FIGS. 1 to 13.

FIG. 14 shows a wall element 14*b* of an appliance body 12*b* of an alternative household appliance device 10*b*. The household appliance device 10*b* has a fixing element 18*b* arranged on the wall element 14*b*. The fixing element 18*b* and the wall element 14*b* are configured separately from one another, in particular as objects which are separate from one another. In an assembled state the fixing element 18*b* is arranged on the wall element 14*b*. In an assembled state the fixing element 18*b* is connected with a material bond to the wall element 14*b*.

The fixing element 18*a* partially defines a receiving region 24*b*. The receiving region 24*b* is provided for receiving a partial region 26*b* of a component 20*b* of the household appliance device 10*b*. The receiving region 24*b* is open in an assembly direction 28*b* which is oriented substantially parallel to a plane spanned by the wall element 14*b*.

The fixing element 18*b* partially defines a second receiving region 90*b*. The receiving region 24*b* and the second receiving region 90*b* are open in different directions. The fixing element 18*b* forms a type of top hat rail.

REFERENCE NUMERALS

10 Household appliance device
12 Appliance body
14 Wall element
16 Isolation chamber
18 Fixing element
20 Component
22 Direction
24 Receiving region
26 Partial region
28 Assembly direction
30 Latching element
32 Width extent
34 Marking unit
36 Assembly position
38 Further fixing element
40 Vertical direction
42 Further receiving region
44 Further partial region
46 Latching element
48 Dismantling element
50 Household appliance
52 Appliance door
54 Further appliance door
56 Positioning surface
58 Side wall
60 Rear wall
62 Bottom wall
64 Ceiling wall
66 Machinery compartment
68 Foaming recess
70 Outer face
72 Longitudinal direction of extent
74 Recess
76 Further longitudinal direction of extent
78 Further latching element
80 Further latching element
82 Assembly tool
84 Dismantling tool
86 Actuating element
88 Actuating recess
90 Second receiving region

The invention claimed is:

1. A household appliance device, comprising:

at least one appliance body having a front, a rear, a depth direction extending from said front to said rear and at least one wall element at least partly delimiting at least one isolation chamber, said at least one wall element spanning a plane;

at least one component;

at least one fixing element and at least one further fixing element disposed on said at least one wall element, said at least one fixing element and said at least one further fixing element configured to fix said at least one component to said at least one wall element;

said at least one fixing element protruding in a direction facing away from said at least one isolation chamber beyond said plane spanned by said at least one wall element;

said at least one fixing element at least partly defining at least one receiving region for receiving at least one partial region of said at least one component; and said at least one further fixing element protruding in a direction facing away from said at least one isolation chamber beyond said plane spanned by said at least one wall element;

said at least one further fixing element disposed rearward of said at least one fixing element in said depth direction.

2. The household appliance device according to claim 1, wherein said at least one receiving region is open in an assembly direction oriented at least substantially parallel to said plane spanned by said at least one wall element.

3. The household appliance device according to claim 1, wherein said at least one fixing element is connected integrally with said at least one wall element.

4. The household appliance device according to claim 1, which further comprises at least one marking unit for marking an assembly position of said at least one component on said at least one fixing element.

5. The household appliance device according to claim 1, wherein said at least one fixing element and said at least one further fixing element are disposed at least partly offset from each other relative to a vertical direction in an installed position.

6. The household appliance device according to claim 1, wherein said at least one fixing element and said at least one further fixing element are oriented at least substantially parallel to one another.

7. The household appliance device according to claim 1, wherein:

said at least one fixing element at least partly defines at least one receiving region for receiving at least one partial region of said at least one component; and said at least one further fixing element defines at least one further receiving region for receiving at least one further partial region of said at least one component.

8. The household appliance device according to claim 1, wherein said at least one component is a housing unit.

9. The household appliance device according to claim 8, wherein said housing unit has at least one latching element for latching to said at least one fixing element.

10. The household appliance device according to claim 8, wherein said housing unit has at least one dismantling element for dismantling said housing unit from said at least one fixing element.

11. A household appliance or household refrigeration appliance, comprising at least one household appliance device according to claim 1.

12. A household appliance device, comprising:

at least one appliance body having a front, a rear, a depth direction extending from said front to said rear and at least one wall element at least partly delimiting at least one isolation chamber, said at least one wall element spanning a plane;

at least one component;

at least one fixing element and at least one further fixing element disposed on said at least one wall element, said at least one fixing element and said at least one further fixing element configured to fix said at least one component to said at least one wall element;

said at least one fixing element protruding in a direction facing away from said at least one isolation chamber beyond said plane spanned by said at least one wall element;

said at least one fixing element at least partly defining at least one latching element for latching said at least one component to said at least one wall element; and said at least one further fixing element protruding in a direction facing away from said at least one isolation chamber beyond said plane spanned by said at least one wall element;

said at least one further fixing element disposed rearward of said at least one fixing element in said depth direction.

13. A household appliance device, comprising:

at least one appliance body having a front, a rear, a depth direction extending from said front to said rear and at least one wall element at least partly delimiting at least one isolation chamber, said at least one wall element spanning a plane;

at least one component;

at least one fixing element and at least one further fixing element disposed on said at least one wall element, said at least one fixing element and said at least one further fixing element configured to fix said at least one component to said at least one wall element;

said at least one fixing element protruding in a direction facing away from said at least one isolation chamber beyond said plane spanned by said at least one wall element;

said at least one fixing element extending over at least 50% of an extent of said at least one wall element parallel to a width extent of said at least one appliance body; and said at least one further fixing element protruding in a direction facing away from said at least one isolation chamber beyond said plane spanned by said at least one wall element;

said at least one further fixing element disposed rearward of said at least one fixing element in said depth direction.

* * * * *